US008974546B2

(12) United States Patent
Ghosh et al.

(10) Patent No.: US 8,974,546 B2
(45) Date of Patent: Mar. 10, 2015

(54) METHOD FOR TREATING LAUNDRY IN A CLOTHES DRYER

(75) Inventors: Kaustav Ghosh, Saint Joseph, MI (US); Thomas A. Latack, Baroda, MI (US); Karl D. McAllister, Stevensville, MI (US); Robert J. Pinkowski, Baroda, MI (US); Prithi A. Rao, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 748 days.

(21) Appl. No.: 12/713,489

(22) Filed: Feb. 26, 2010

(65) Prior Publication Data

US 2011/0209293 A1 Sep. 1, 2011

(51) Int. Cl.

| | |
|---|---|
| ***D06L 1/22*** | (2006.01) |
| ***D06F 35/00*** | (2006.01) |
| ***D06F 39/02*** | (2006.01) |
| ***D06F 58/20*** | (2006.01) |

(52) U.S. Cl.

CPC ..... *D06F 35/00* (2013.01); *D06F 39/02* (2013.01); *D06F 58/203* (2013.01)

USPC ..... 8/137; 8/115.51; 8/116.1; 8/115.54; 252/8.61; 252/8.62; 252/8.63

(58) Field of Classification Search

USPC ..... 8/115.54

See application file for complete search history.

(56) References Cited

U.S. PATENT DOCUMENTS

| | | | | |
|---|---|---|---|---|
| 3,595,036 | A | | 7/1971 | DePas |
| 3,650,816 | A | | 3/1972 | Rudy et al. |
| 3,872,604 | A | * | 3/1975 | Keller ..... 34/342 |
| 4,014,105 | A | | 3/1977 | Furgal et al. |
| 4,130,392 | A | | 12/1978 | Diehl et al. |
| 4,207,683 | A | * | 6/1980 | Horton ..... 34/60 |
| 4,313,732 | A | | 2/1982 | Teague et al. |
| 4,417,897 | A | | 11/1983 | Stahl et al. |
| 4,489,455 | A | | 12/1984 | Spendel |
| 4,599,087 | A | | 7/1986 | Heller et al. |
| 5,293,648 | A | | 3/1994 | Finley |
| 5,474,691 | A | | 12/1995 | Severns |
| 6,495,058 | B1 | | 12/2002 | Frankenbach et al. |
| 6,645,928 | B1 | | 11/2003 | Kenney et al. |
| 6,726,731 | B2 | | 4/2004 | Pettifer et al. |
| 6,818,021 | B2 | | 11/2004 | Noyes et al. |
| 6,889,399 | B2 | | 5/2005 | Steiner et al. |
| 6,966,696 | B1 | | 11/2005 | Curry et al. |
| 7,021,087 | B2 | | 4/2006 | France et al. |
| 7,047,663 | B2 | | 5/2006 | Zhang et al. |
| 7,047,666 | B2 | | 5/2006 | Hahn et al. |
| 7,060,106 | B2 | | 6/2006 | Kleker |
| 7,320,184 | B2 | | 1/2008 | Zhang et al. |
| 7,325,330 | B2 | | 2/2008 | Kim et al. |

(Continued)

FOREIGN PATENT DOCUMENTS

| | | |
|---|---|---|
| DE | 3408136 A1 | 9/1985 |
| EP | 0151370 A2 | 8/1985 |

(Continued)

*Primary Examiner* — Harold Pyon

*Assistant Examiner* — Katie L Hammer

(57) ABSTRACT

A method for treating laundry in a clothes dryer having a rotating drum defining a treatment chamber that includes applying a treating chemistry, which may include a treating chemistry that benefits from uniform distribution, on the laundry and drying the laundry after the applying of the treating chemistry.

50 Claims, 4 Drawing Sheets

(56) References Cited

U.S. PATENT DOCUMENTS

| | | | | |
|---|---|---|---|---|
| 2004/0137818 | A1* | 7/2004 | Kimbrell et al. | 442/211 |
| 2004/0226106 | A1 | 11/2004 | Gardner et al. | |
| 2005/0092035 | A1 | 5/2005 | Shin et al. | |
| 2005/0229327 | A1* | 10/2005 | Casella et al. | 8/115.51 |
| 2005/0262645 | A1 | 12/2005 | Yang et al. | |
| 2006/0090524 | A1 | 5/2006 | Jeon et al. | |
| 2006/0191076 | A1 | 8/2006 | Bonfa | |
| 2007/0163094 | A1 | 7/2007 | Wright et al. | |
| 2008/0034511 | A1 | 2/2008 | Batchelor et al. | |
| 2008/0096789 | A1 | 4/2008 | Batchelor | |
| 2008/0235884 | A1* | 10/2008 | Sadlowski et al. | 8/442 |
| 2008/0307667 | A1 | 12/2008 | Ikemizu | |
| 2009/0071032 | A1 | 3/2009 | Kreutzfeldt et al. | |
| 2009/0094854 | A1* | 4/2009 | Cimetta et al. | 34/562 |
| 2009/0113745 | A1 | 5/2009 | Choi et al. | |
| 2009/0113755 | A1 | 5/2009 | Choi et al. | |

FOREIGN PATENT DOCUMENTS

| | | | |
|---|---|---|---|
| EP | 0676497 | B1 | 10/1995 |
| EP | 1441060 | A1 | 7/2004 |
| EP | 1852540 | A1 | 11/2007 |
| EP | 1983093 | A1 * | 10/2008 |
| EP | 2055824 | A1 | 5/2009 |
| GB | 1357740 | | 6/1974 |
| WO | 2007/093303 | A1 | 8/2007 |
| WO | 2008/016262 | A2 | 2/2008 |

* cited by examiner

METHOD FOR TREATING LAUNDRY IN A CLOTHES DRYER

BACKGROUND OF THE INVENTION

Laundry treating appliances, such as clothes dryers, refreshers, and non-aqueous systems, may have a configuration based on a rotating drum that defines a treating chamber in which laundry items are placed for treating according to a cycle of operation. The laundry treating appliance may have a controller operably connected with the various components of the laundry treating appliance to execute the cycle of operation. The cycle of operation may be selected manually by the user or automatically based on one or more conditions determined by the controller.

Dispensing dryers, while known, are still an uncommon type of clothes dryer, which dispense a treating chemistry onto a load of laundry during a drying cycle of operation. The treating chemistry may be any chemistry applied to the laundry such as water, bleach, perfume, softener, stain guard, anti-wrinkling or the like.

SUMMARY OF THE INVENTION

A method for treating laundry in a clothes dryer having a rotating drum defining a treatment chamber. The method includes applying a treating chemistry, which may include a treating chemistry that benefits from uniform distribution, on the laundry and drying the laundry after the applying of the treating chemistry.

DESCRIPTION OF EMBODIMENTS OF THE INVENTION

Figure 1:
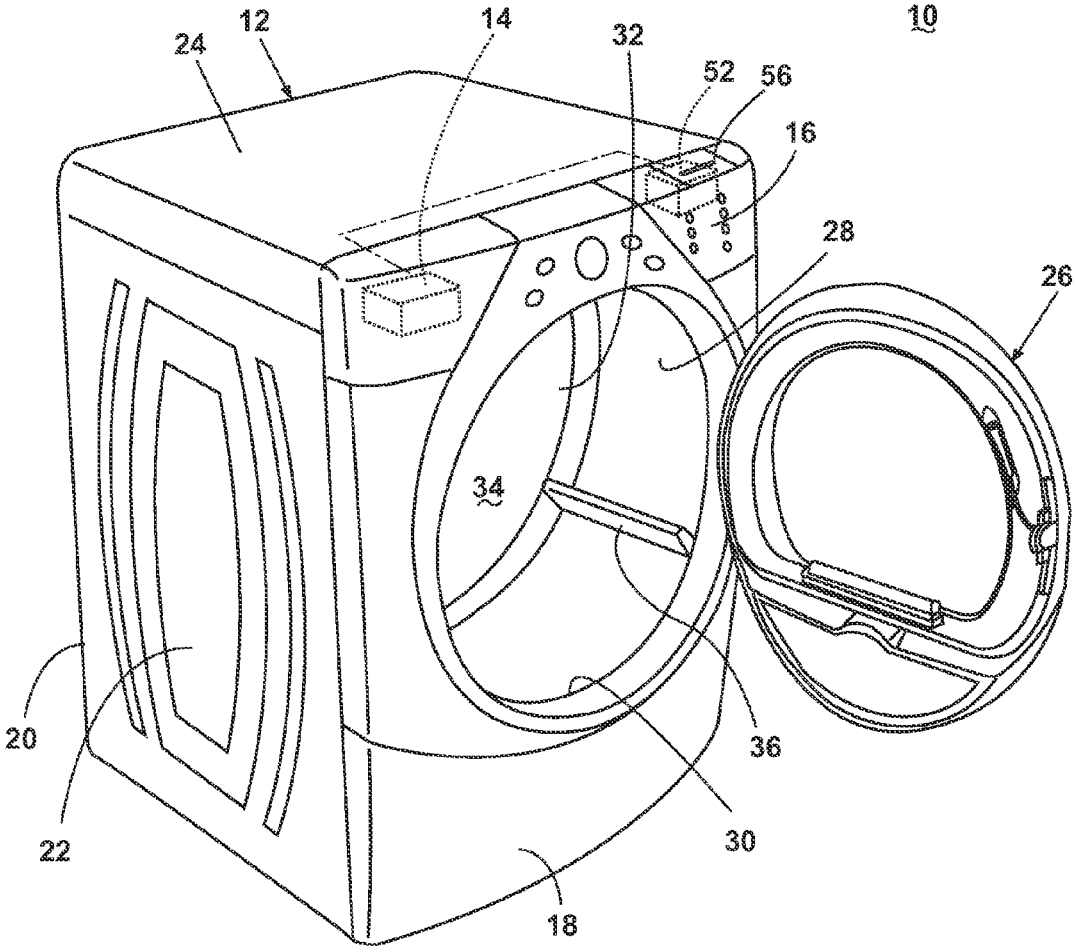
FIG. 1 is a front perspective view of a clothes dryer, wherein the clothes dryer may be controlled based on a method according to one embodiment of the invention.

FIG. 1 illustrates one embodiment of a laundry treating appliance in the form of a dispensing clothes dryer 10 according to the invention. While the laundry treating appliance is illustrated as a front-loading dryer, the laundry treating appliance according to the invention may be another appliance which performs a cycle of operation on laundry, non-limiting examples of which include a top-loading dryer, a combination washing machine and dryer; a tumbling or stationary refreshing/revitalizing machine; an extractor; a non-aqueous washing apparatus; and a revitalizing machine. The clothes dryer 10 described herein shares many features of a traditional automatic clothes dryer, which will not be described in detail except as necessary for a complete understanding of the invention.

As illustrated in FIG. 1, the clothes dryer 10 may include a cabinet 12 in which is provided a controller 14 that may receive input from a user through a user interface 16 for selecting a cycle of operation and controlling the operation of the clothes dryer 10 to implement the selected cycle of operation. The clothes dryer 10 will offer the user a number of pre-programmed cycles of operation to choose from, and each pre-programmed cycle of operation may have any number of adjustable cycle modifiers. Examples of such modifiers include, but are not limited to chemistry dispensing, load amount, a load color, and/or a fabric type.

The cabinet 12 may be defined by a front wall 18, a rear wall 20, and a pair of side walls 22 supporting a top wall 24. A door 26 may be hingedly mounted to the front wall 18 and may be selectively moveable between opened and closed positions to close an opening in the front wall 18, which provides access to the interior of the cabinet 12.

A rotatable drum 28 may be disposed within the interior of the cabinet 12 between opposing front and rear bulkheads 30 and 32, which collectively define a treating chamber 34 having an open face that may be selectively closed by the door 26. The drum 28 may include at least one baffle or lifter 36. In most clothes dryers, there are multiple lifters. The lifters 36 may be located along the inner surface of the drum 28 defining an interior circumference of the drum 28. The lifters 36 may facilitate movement of laundry within the drum 28 as the drum 28 rotates.

Figure 2:
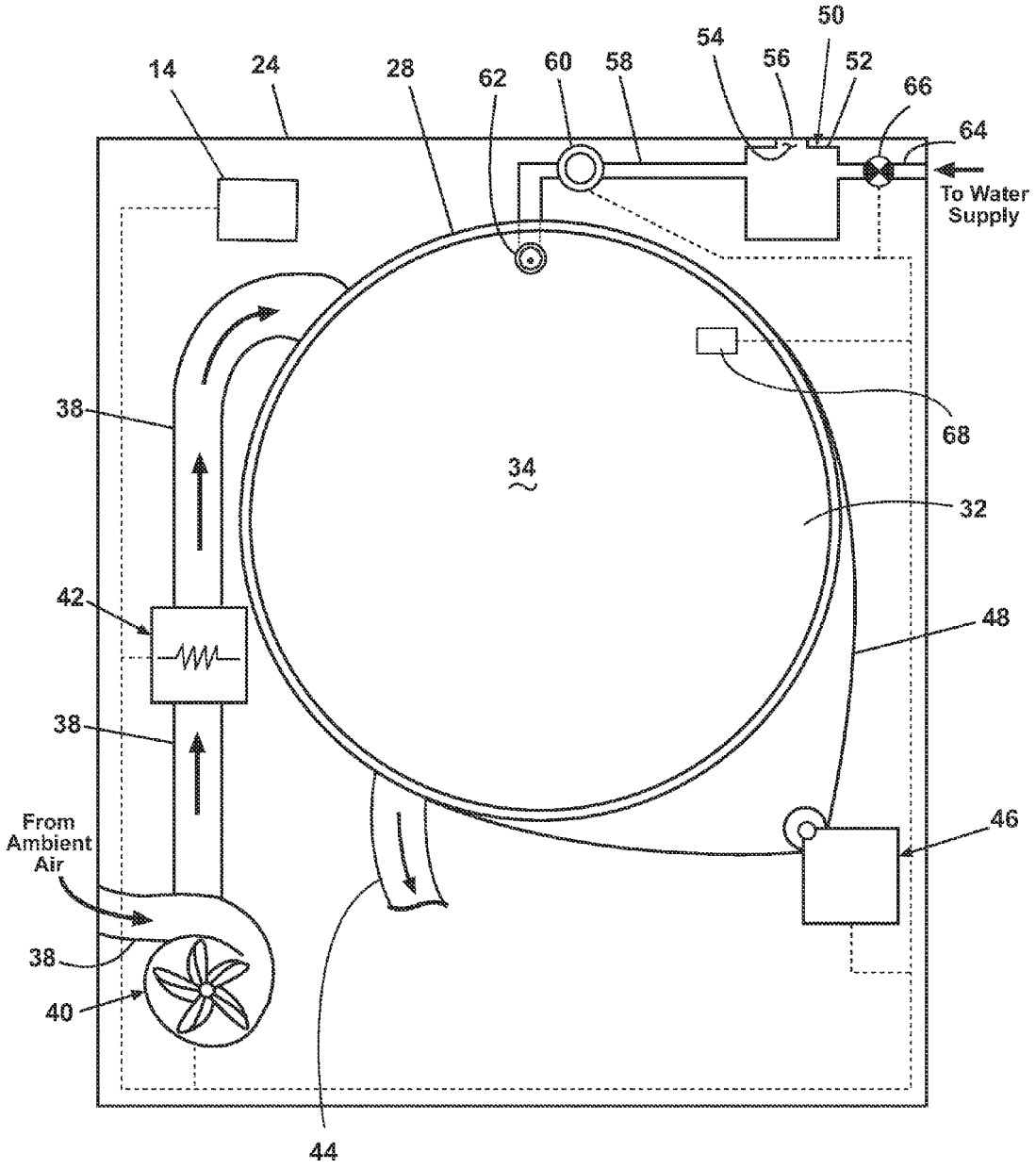
FIG. 2 is a front schematic view of the clothes dryer of FIG. 1.

Referring to FIG. 2, an air flow system for the clothes dryer 10 supplies air to the treating chamber 34 and then exhausts air from the treating chamber 34. The air flow system may have an air supply portion that may be formed in part by an inlet conduit 38, which has one end open to the ambient air and another end fluidly coupled to the treating chamber 34. Specifically, the inlet conduit 38 may couple with the treating chamber 34 through an inlet grill (not shown) formed in the rear bulkhead 32. A blower 40 and a heating element 42 may lie within the inlet conduit 38 and may be operably coupled to and controlled by the controller 14. If the heating element 42 is turned on, the supplied air will be heated prior to entering the drum 28. The air supply system may further include an air exhaust portion that may be formed in part by an exhaust conduit 44. Operation of the blower 40 draws air into the treating chamber 34 by the inlet conduit 38 and exhausts air from the treating chamber 34 through the exhaust conduit 44. The exhaust conduit 44 may be fluidly coupled with a household exhaust duct (not shown) for exhausting the air from the treating chamber 34 to the outside environment. However, other air flow systems are possible as well as other arrangements of the blower 40 and heating element 42. For example, the blower 40 may be located in the exhaust conduit 44 instead of the inlet conduit 38.

As is typical in a clothes dryer, the drum 28 may be rotated by a suitable drive mechanism, which is illustrated as a motor 46 and a coupled belt 48. The motor 46 may be operably coupled to the controller 14 to control the rotation of the drum 28 to complete a cycle of operation. Other drive mechanisms, such as direct drive, may also be used.

The clothes dryer 10 may also have a dispensing system 50 for dispensing treating chemistries into the treating chamber 34. The dispensing system 50 may introduce treating chemistry into the drum 28 in any suitable manner, such as by spraying, dripping, or providing a steady flow of the treating chemistry. The treating chemistry may be in a form of gas, liquid, solid or any combination thereof and may have any chemical composition enabling refreshment, disinfection, whitening, brightening, increased softness, reduced odor, reduced wrinkling, stain repellency or any other desired treatment of the laundry. Water is one example of a suitable treating chemistry. Other non-limiting examples of suitable treating chemistries are chromophore chemistry, softening chemistry, and stain-repellency chemistry. In all cases, the treating chemistries may be composed of a single chemical, a mixture of chemicals, or a solution of water and one or more chemicals.

The dispensing system 50 may include a reservoir 52 capable of holding a treating chemistry, a reservoir opening 54 that provides access to the reservoir 52 and that is selectively closed by a cover 56. The cover lid 56 may provide access to the reservoir 52 from the exterior of the cabinet 12 such that a user may fill the reservoir 52 as needed. The reservoir 52 may include a chemistry level detector (not shown) that may be used to detect a level of treating chemistry in the reservoir 52. The reservoir 52 may also have multiple chambers, each of which holds a different treating chemistry to provide for the dispensing of multiple treating chemistries. While the reservoir 52 is described as a refillable chamber, the reservoir 52 could be a chamber that receives one or more cartridges containing one or more treating chemistries, or any other suitable reservoir configuration.

The dispensing system 50 may have a chemistry supply line 58 fluidly coupling the reservoir 52 and the drying chamber 34, a chemistry meter 60, and a dispenser 62. Chemistry may be delivered to the dispenser 62 via the chemistry supply line 58 from the reservoir 52. Then the dispenser 62 may dispense the chemistry into the treating chamber 34. The dispenser 62 may be located on the rear bulkhead 32 and may be positioned to direct the treating chemistry at the inner surface of the drum 28 so that laundry may contact and absorb the chemistry, or to dispense the treating chemistry directly onto the laundry in the treating chamber 34. The chemistry meter 60, which may be a pump, may electronically couple, wired or wirelessly, to the controller 14 to control the amount of chemistry dispensed. The chemistry meter 60 may be provided inline of the chemistry supply line 58 to control the dispensing of the treating chemistry from the reservoir 52.

The type of dispenser 62 is not germane to the invention. The dispenser 62 may be a rigid nozzle or may be a flexible nozzle constructed of a material such as silicone, or polyethylene. It should be readily understood that the type of dispenser 62 and/or the number of dispensers 62 may be changed. For example, there may be any number of dispensers 62 positioned to direct the treating chemistry into the treating chamber 34. Types of dispensers 62 that may be used, include, but are not limited to, nozzles, misters, nebulizers, steamers, or any other outlet that produces a spray. The dispenser 62 may dispense the treating chemistry and other fluids as a continuous stream, a mist, an intermittent stream, or various other spray patterns.

A water supply line 64 may be fluidly coupled to the reservoir 52 and may have a water supply valve 66 mounted thereon. The reservoir 52 may be supplied with water from a water supply, such as a home water supply line, via the water supply line 64. Water may or may not be supplied to the reservoir 52 depending on the specific cycle of operation being carried out by the clothes dryer 10. The amount of water supplied to the reservoir 52 may be regulated by the water supply valve 66, which may be operated by the controller 14. The controller 14 may operate the water supply valve 66 based on the cycle of operation and any selected cycle modifiers, which may include supplying a predetermined amount of water to the reservoir 52. The water supply line 64 may also be configured to selectively dispense water directly to the treating chamber 34.

The clothes dryer 10 may be provided with a moisture sensor 68 to determine the moisture content of laundry in the treating chamber 34. One example of a moisture sensor 68 is a conductivity strip. The moisture sensor 68 may be operably coupled to the controller 14 such that the controller 14 receives output from the moisture sensor 68. The moisture sensor 68 may be mounted at any location in the interior of the dispensing dryer 10 such that the moisture sensor 68 may be able to accurately sense the moisture content of the laundry. For example, the moisture sensor 68 may be coupled to one of the bulkheads 30, 32 of the drying chamber 34 by any suitable means.

Figure 3:
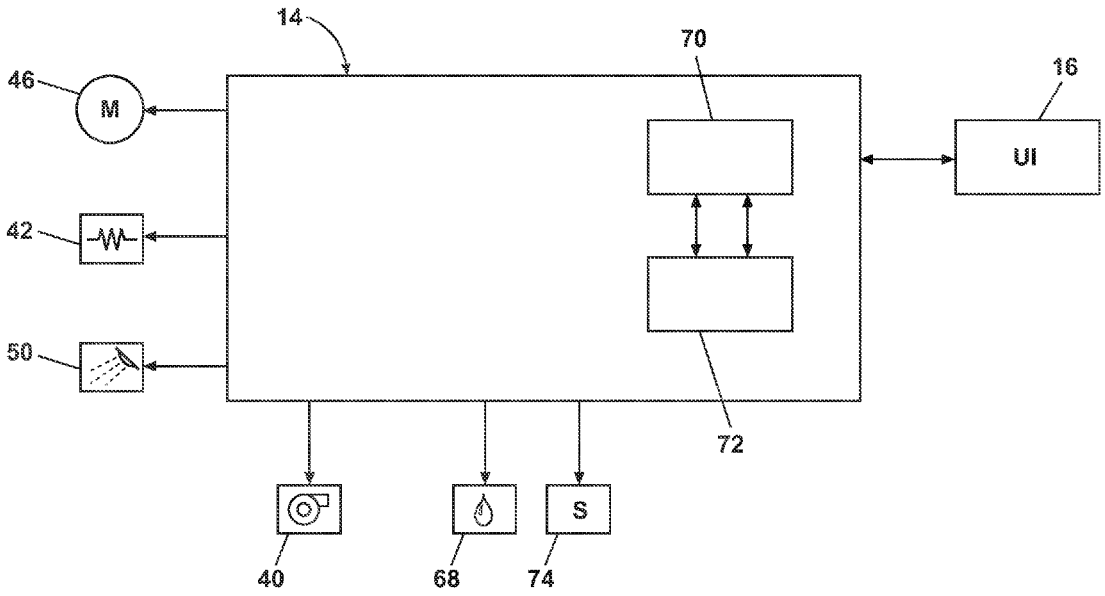
FIG. 3 is a schematic representation of a controller for controlling the operation of one or more components of the clothes dryer of FIG. 1.

As illustrated in FIG. 3, the controller 14 may be provided with a memory 70 and a central processing unit (CPU) 72. The memory 70 may be used for storing the control software that may be executed by the CPU 72 in completing a cycle of operation using the clothes dryer 10 and any additional software. The memory 70 may also be used to store information, such as a database or table, and to store data received from the one or more components of the clothes dryer 10 that may be communicably coupled with the controller 14.

The controller 14 may be operably coupled with one or more components of the clothes dryer 10 for communicating with and/or controlling the operation of the component to complete a cycle of operation. For example, the controller 14 may be coupled with the blower 40 and the heating element 42 for controlling the temperature and flow rate through the treatment chamber 34; the motor 46 for controlling the direction and speed of rotation of the drum 28; the dispensing system 50 for dispensing a treatment chemistry during a cycle of operation; the moisture sensor 68 for receiving information about the moisture content of the laundry; and the user interface 16 for receiving user selected inputs and communicating information to the user. The controller 14 may also receive input from various additional sensors 74, which are known in the art and not shown for simplicity. Non-limiting examples of additional sensors 74 that may be communicably coupled with the controller 14 include: a treating chamber temperature sensor, an inlet air temperature sensor, an exhaust air temperature sensor, an air flow rate sensor, a weight sensor, and a motor torque sensor.

Generally, in normal operation of the clothes dryer 10, a user first selects an appropriate cycle of operation via the user interface 16. The user may also select one or more cycle modifiers. In accordance with the user-selected cycle and cycle modifiers, the controller 14 may control the operation of the rotatable drum 28, the blower 40, the heating element 42, and the dispensing system 50, to implement the cycle of operation to treat the laundry. When appropriate, the motor 46 rotates the drum 28 via the belt 48. The blower 40 draws air through the inlet conduit 38 and into the treating chamber 34, as illustrated by the flow vectors. The air may be heated by the heating element 42. Air may be vented through the exhaust conduit 44 to remove moisture from the treating chamber 34. During the cycle, treating chemistry may be dispensed into the treating chamber 34. Also during the cycle, output generated by the moisture sensor 68 and any additional sensors 74 may be utilized to generate digital data corresponding to sensed operational conditions inside the treating chamber 34. The output may be sent to the controller 14 for use in calculating operational conditions inside the treating chamber 34, or the output may be indicative of the operational condition. Once the output is received, the controller 14 processes the output for storage in the memory 70. The controller 14 may convert the output during processing such that it may be properly stored in the memory 70 as digital data. The stored digital data may be processed in a buffer memory, and used, along with pre-selected coefficients, in algorithms to electronically calculate various operational conditions, such as a degree of wetness or moisture content of the laundry. The controller 14 may use both the cycle modifiers specified by the user and the additional information obtained by the sensors 68, 74 to carry out the desired cycle of operation.

The previously described clothes dryer 10 provides the structure necessary for the implementation of the method of the invention. Several embodiments of the method will now be described in terms of the operation of the clothes dryer 10. The embodiments of the method function to ensure that a liquid treating chemistry is uniformly distributed onto a load of laundry.

Before specific embodiments of the methods are presented, a description of the concepts behind the methods may be constructive. Different types of fabrics have different surface energies, or surface tensions in the case of liquids. For example, cotton is very hydrophilic and has a high surface energy, while polyester is very hydrophobic and has a lower surface energy compared to cotton. If a liquid treating chemistry is dispensed directly on a load with a non-uniform surface energy, the liquid treating chemistry may not be uniformly distributed on the load since the liquid treating chemistry will be more strongly attracted to fabrics with higher surface energy.

A chromophore is a chemical group in a compound that is responsible for the color of the compound by selectively absorbing light at particular wavelengths. Non-limiting examples of molecules that contain a chromophore group are dyes and polymeric colorants. One type of polymeric colorants consist of a polymer backbone attached to a chromophore; non-limiting examples of the polymeric backbone include poly(ethylene oxide), poly(ethylene oxide)-diacetate, poly(vinylamine), and poly(alkyl-vinylamine).

When deposited on a fabric, a whitening chromophore selectively absorbs regions of the visible light spectrum when the fabric is excited by visible light and reflects back a whiter color compared to the fabric's original color. For example, when a whitening chromophore is deposited on a white fabric that has a yellowish or reddish tinge, a whitening chromophore selectively absorbs the yellow and red regions of the visible light spectrum when the fabric is excited by visible light and hence reflects back a greater percentage of light in the blue region of the visible light spectrum, thus making the fabric look whiter compared to it's original color. If a liquid treating chemistry containing a chromophore is non-uniformly distributed onto a load of laundry, the load will not have a uniform appearance after drying. Higher concentrations of such a whitening chromophore may appear as a blue discoloration on the fabric.

Figure 4:
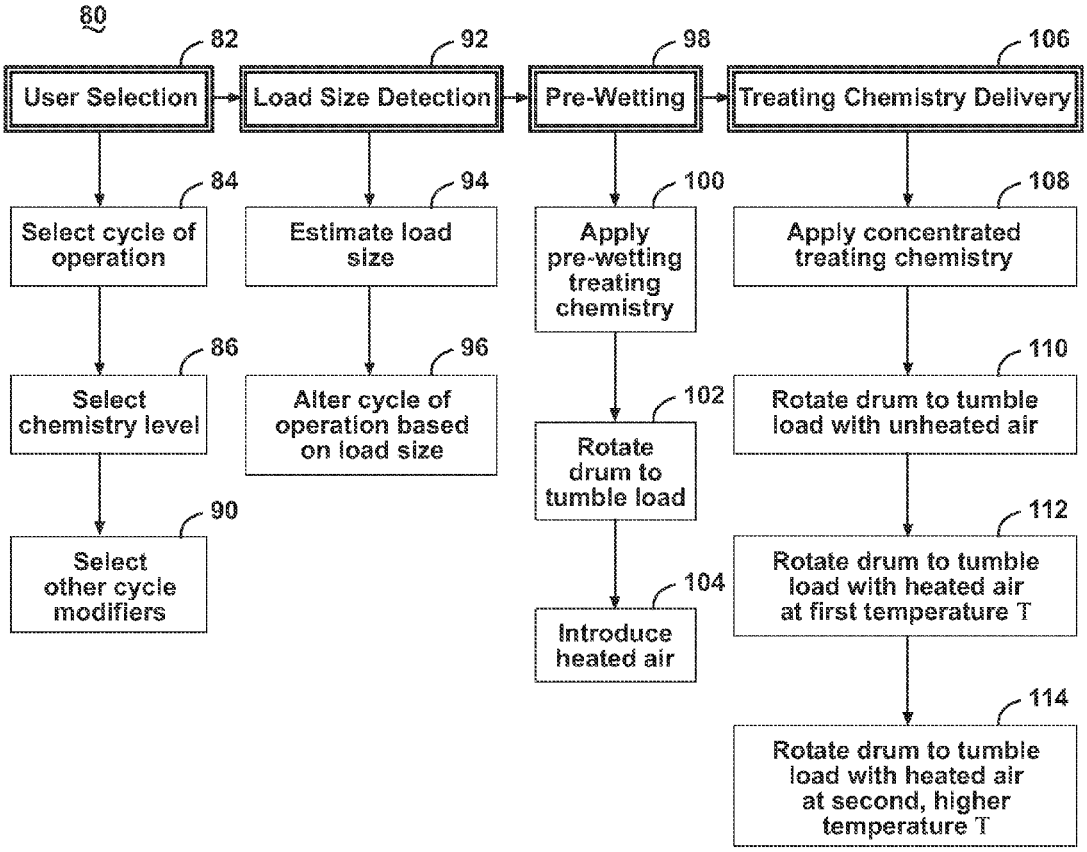
FIG. 4 is a flow-chart depicting a method according to one embodiment of the invention.

Referring to FIG. 4, a flow-chart depicting a method 80 for treating laundry according to one embodiment of the invention is shown, and includes a more specific cycle of operation based on the normal operation described above. The method 80 may be carried out by the controller 14 using information inputted by the user via the user interface 16 and from the sensors 68, 74. The sequence of steps depicted is for illustrative purposes only and is not meant to limit the method 80 in any way as it is understood that the steps may proceed in a different logical order, additional or intervening steps may be included, or described steps may be divided into multiple steps, without detracting from the invention.

The method 80 begins with a user selection phase 82 in which a user may select a cycle of operation at 84. Non-limiting examples of cycles of operation include a normal drying cycle, a refreshing cycle, and a chemistry-enhanced drying cycle. A normal drying cycle generally includes drying the load without the application of a treating chemistry. A refreshing cycle generally includes applying a treating chemistry to a dry or relatively dry load and thereafter drying the load. A chemistry-enhanced drying cycle generally includes applying a treating chemistry to wet load and drying the load. The method 80 described herein may be applicable to a refreshing cycle and a chemistry-enhanced drying cycle.

The user may also optionally select cycle modifiers for the cycle of operation. At 86, the user may select the level of treating chemistry dispensed during the cycle of operation. Examples of treating chemistry levels include off, i.e. no treating chemistry dispensed, low, medium and high. The user may also optionally select other cycle modifiers at 90, such as a load amount, a load color, and/or a fabric type. Examples of load amounts are extra-small, small, medium, large, or extra-large. Examples of load colors are whites and colors. Examples of fabric types are cotton, silk, polyester, delicates, permanent press, and heavy duty. The selection(s) 84-90 may be performed via the user interface 16 of the clothes dryer 10. The user's selections may be communicated to the controller 14, and the cycle of operation may commence.

The cycle of operation begins with an optional load amount detection phase 92. However, if the user selects a load amount during the user selection phase 82, the load mass detection phase 92 may be unnecessary. The load amount detection phase 92 includes estimating the load amount at 94. Estimating the load amount may include automatically detecting the load amount of the load of laundry in the treating chamber 34. The detected load amount may be quantitative or qualitative. Examples of quantitative load amounts are the mass, volume, or surface area of the load, or the number of articles making up the load. Examples of qualitative load amounts are extra-small, small, medium, large, or extra-large.

There are many ways in which the clothes dryer 10 may automatically detect the load amount. For example, an inertia-based detection method may be used to determine the load amount. Examples of an inertia-based detection methods for determining the amount of the load is disclosed in U.S. Patent Application No. 2006/0242768 to Zhang et al. assigned to the same assignee as the present invention, U.S. Pat. No. 6,505,369 to Weinmann, and U.S. Pat. No. 7,162,759 to Weinmann, all of which are incorporated in full by reference.

At 96, the controller 14 may alter the cycle of operation based on the load amount, regardless of whether the load amount is inputted by the user during the user selection phase 82 or estimated at 94. For example, dispensing times and/or treating chemistry amounts may be altered at 96 based on the load amount.

Next, a pre-wetting phase 98 of the cycle of operation may commence. The pre-wetting phase 98 includes applying a pre-wetting treating chemistry onto the load of laundry at 100. The load of laundry may be tumbled by rotating the drum 28 during at least a portion of the application at 100. This will increase the exposure of items of laundry to the pre-wetting treating chemistry.

The pre-wetting phase 98 may include operating the chemistry meter 60 and/or the water supply valve 66 for predetermined periods of time as determined by the controller 14 to achieve a desired pre-wetting treating chemistry composition. For example, the pre-wetting treating chemistry may be water; as such, only the water supply valve 66 need be turned on during the pre-wetting phase. In another example, the pre-wetting treating chemistry may be a dilute treating chemistry. In this case, both the chemistry meter 60 and the water supply valve 66 may be turned on during the pre-wetting phase. The dilute treating chemistry or a solute for mixing with water to create the dilute treating chemistry may be stored in the reservoir 52. One non-limiting example of a dilute treating chemistry may be solution of water and a surfactant. Non-limiting examples of surfactants are nonionic surfactants with chemical structures based on polyethylene oxide (PEO) or block co-polymers based on polyethylene oxide and polypropylene oxide (PEO-PPO) or triblock copolymers (PEO-PPO-PEO). Such surfactants can also be either cationic or anionic, with some examples of such being Linear alkyl benzyl sulfonate (LAS) or sulfate and quaternary ammonium salts. The dilute treating chemistry may also contain other chemicals, including chromophore chemicals, softening chemicals, and/or stain-repellency chemicals.

The pre-wetting treating chemistry may be applied until the surface energy of the laundry is substantially equalized. Equalizing the surface energy of the load includes giving the load a uniform surface energy. This will ensure that any future liquid treating chemistry dispensed on the load will be uniformly distributed which will avoid spot application of the treating chemistry and is especially beneficial when using a treating chemistry having a visible effect on the laundry, such as whiteners/brighteners like chromophores, or other chemistries benefit from uniform surface energy, such as stain-repellency chemicals. The pre-wetting treating chemistry may serve as an equalizing liquid that will substantially equalize the surface energy of the load. The pre-wetting treating chemistry may be applied on the load to form a substantially even layer on the load to ensure that surface energy is equalized. A predetermined amount of pre-wetting treating chemistry may be applied to the load, and that amount may be selected to be sufficient to form a substantially even layer of the pre-wetting treating chemistry on the load.

The substantially even layer of pre-wetting treating chemistry may serve as a liquid transportation layer on the load. The liquid transportation layer will help transport or distribute any liquid treating chemistries dispensed in the remainder of the cycle uniformly over the load. The liquid transportation layer may also keep the pre-wetting treating chemistry solubilized for a longer time, increasing the time it has to spread out over the laundry.

One indicator that the surface energy of the laundry is equalized is the moisture content of the laundry. Therefore, the surface tension of the laundry may be substantially equalized by wetting the load with the pre-wetting treating chemistry until the laundry has a predetermined moisture content. For example, the pre-wetting treating chemistry may be sprayed onto the load of laundry until the laundry has a moisture content of approximately 10-25%. As such, the load of laundry may be dry, or at least may have a moisture content less than approximately 10-25% when first sprayed with the pre-wetting treating chemistry. The moisture content may be detected by the moisture sensor 68. The predetermined moisture content may be chosen as being one that will saturate the most absorbent fabric type in the load of laundry, and will therefore be likely associated with an equalized surface energy for the load. One example of moisture content that may be detected by the moisture sensor 68 and may be used as an indicator that the surface energy is equalized is the surface moisture content of the laundry.

Moisture content is only one possible indicator that surface energy is equalized, and it may not always be a guaranteed indicator. Depending on the type of moisture sensor 68, the particular load of laundry, and the environmental conditions within the treating chamber 34, it might be possible for the moisture sensor 68 to read the predetermined moisture content without the surface energy of the load being equalized. For example, with cotton fabrics and a slow tumble speed, it is possible for a few items to remain stationary about the moisture sensor 68, especially for a "wet hit" moisture sensor. If the dispenser 62 applies the pre-wetting treating chemistry generally in that area, the few items will receive the majority of the pre-wetting treating chemistry and the moisture sensor 68 may show that the load has the predetermined moisture content, even though the entire load does not have the predetermined moisture content in actuality. Therefore, equalized surface energy is not inherent with a particular moisture content.

After the surface energy is equalized, the drum 28 may be rotated to tumble the load at 102. The load may be tumbled to achieve uniform distribution of the pre-wetting treating chemistry on the load, which may start out having a non-uniform moisture distribution even if the surface energy is equalized. The duration of tumbling may be time-based, whereby the load is tumbled for a time sufficient for the load to have uniform distribution of the pre-wetting treating chemistry and/or uniform moisture content. For example, the load may be tumbled for one to four minutes. The duration of tumbling may be event-based, whereby the load is tumbled until the load has a uniform moisture content. Unheated air may be introduced into the treating chamber 34 during tumbling.

Optionally, heated air may be introduced into the treating chamber 34 at 104 after the pre-wetting treating chemistry is uniformly distributed on the load. Since, as discussed above with respect to 100, the predetermined moisture content may be chosen as being one that will saturate the most absorbent fabric type in the load of laundry; the heated air may evaporate the excess pre-wetting treating chemistry from the surface of the load. Heated air may be introduced for a time sufficient to evaporate some or all of the water in the pre-wetting treating chemistry to form water vapor droplets that will increase the humidity of the air within the clothes dryer 10. This creates a fog-like atmosphere in the treating chamber 34, which will decrease the evaporation rate in the treating chamber 34. For example, heated air may be introduced for approximately two minutes.

Next, a treating chemistry delivery phase 106 of the cycle of operation may commence. The treating chemistry delivery phase includes applying a concentrated treating chemistry onto the load of laundry at 108. This may include operating the chemistry meter 60 and/or the water supply valve 66 for predetermined periods of time as determined by the controller 14 to achieve a desired concentrated treating chemistry composition. For example, the concentrated treating chemistry may be a solution of water and a chromophore chemistry stored in the reservoir. In another example, the concentrated treating chemistry may be a solution of water and a stain-repellency chemistry stored in the reservoir. In either case, both the chemistry meter 60 and the water supply valve 66 may be turned in during the treating chemistry delivery phase 106. In another example, the reservoir 52 may hold the concentrated treating chemistry; as such only the chemistry meter 60 need be turned on during the treating chemistry delivery phase 106. The load of laundry may be tumbled by rotating the drum 28 during at least a portion of the spraying at 106. This will increase the exposure of items of laundry to the concentrated treating chemistry.

During application at 108, a predetermined amount of concentrated treating chemistry may be applied to the load and/or the concentrated treating chemistry may be applied to the load for a predetermined time. The application of the concentrated treating chemistry may be based at least on part on the load amount determined in the load amount detection phase 92 or inputted by the user in the user selection phase 82. The predetermined amount and/or the predetermined time may be based on the load amount. The predetermined amount and/or the predetermined time may, alternately or additionally, be based on the amount of pre-wetting treating chemistry applied at 100.

The concentrated treating chemistry may be a liquid treating chemistry that is sprayed onto the load of laundry. For example, the concentrated treating chemistry may be a chromophore chemistry that is a mixture of water and one or more chromophore(s). The concentrated treating chemistry may be a more concentrated form of the pre-wetting treating chemistry. For example, the pre-wetting treating chemistry may be a 0-1% chromophore solution while the concentrated treating chemistry may be a 2-6% chromophore solution for a refreshing cycle or a 5-10% chromophore solution for a chemistry-enhanced drying cycle. In another example, the concentrated treating chemistry may be a stain-repellency chemistry that is a mixture of water and one or more stain-repellent chemical(s). In this case, the pre-wetting treating chemistry may be a 0-1% stain-repellent solution, while the concentrated treating chemistry may be a 2.5-7.5% stain-repellent solution for a refreshing cycle or a 5-15% stain-repellent solution for a chemistry-enhanced drying cycle. One non-limiting example of a stain-repellent chemical is polydimethylsiloxane (PDMS).

Since the surface energy of the load may be substantially equalized during the pre-wetting phase 98, the concentrated treating chemistry may be more uniformly distributed over the load in the treating chemistry delivery phase 106. The concentrated treating chemistry may be transported or distributed evenly of the load due to the liquid transportation layer formed on the load by the pre-wetting treating chemistry.

The concentrated treating chemistry may be applied until the laundry has a desired moisture content. For example, the concentrated treating chemistry may be sprayed onto the load of laundry until the laundry has a moisture content of approximately 10-25%. As such, the load of laundry may be dry, or at least may have a moisture content less than approximately 10-25% when first sprayed with the concentrated treating chemistry.

After the desired moisture content is reached, the drum 28 may be rotated to tumble the load at 110. The load may be tumbled for a time sufficient for the load to achieve uniform distribution of the concentrated treating chemistry on the load. For example, the load may be tumbled for one to five minutes. Unheated air may be introduced into the treating chamber 34 during tumbling. Tumbling with unheated air may decrease the evaporation rate of water from the load, which may provide for a uniform distribution of the concentrated treating chemistry by keeping the treating chemistry below the solubility limit of the chemical(s) within the treating chemistry, thereby keeping the chemicals dissolved within the treating chemistry solution for a longer amount of time. As water evaporates from the load, the chemical (i.e. the solute) concentration in the treating chemistry increases. If chemical concentration increases above the solubility limit, the chemical will precipitate out of solution and deposit on the surface of the load. Since there is a possibility that the chemical molecules are not uniformly distributed on the load immediately after the application of the concentrated treating chemistry at 108, the precipitated chemical(s) may be deposited non-uniformly on the load. In the case of the chemical(s) including a polymeric colorant, the chemical(s) will appear as non-uniform color on the fabric surface.

Heated air may be introduced into the treating chamber 34 after the concentrated treating chemistry is uniformly distributed on the load while still tumbling the load. This may be done in two stages. The temperature of the heated air may be controlled to deliver heated air at a first temperature at 112, and at a second temperature, higher than the first temperature, at 114. At 112, the heated air at the first, lower temperature may be supplied for time sufficient to uniformly deposit molecules of the concentrated treating chemistry on the laundry. In same cases, often dependent on the fabric type, the time may also be sufficient to bond molecules of the concentrated treating chemistry to the laundry. At 114, the heated air at the second, higher temperature may be supplied for a time sufficient to dry the load.

To better understand the benefit of using a two-stage heated air introduction to dry the treated load, the phenomenon of drying a chemical solution is briefly explained. A droplet of chemical solution on a surface proceeds to dry by first spreading out to a maximum diameter on the surface, after which the outer edge of the droplet becomes fixed by surface tension and other interactive forces between the chemical solution and the surface. The most evaporation of water occurs at the outer edge and the solute in the chemical solution precipitates out of the chemical solution at the outer edge as the evaporation of water occurs. Next, in order to replenish the water removed through evaporation at the outer edge, solution from the inner bulk region of the droplet flows to the outer edge, carrying more solute to the outer edge. Evaporation of water at the outer edge continues, and more solute is deposited at the outer edge. The cycle of evaporation and deposition continues, finally resulting in a much higher concentration of solutes at the outer edge of the droplet and non-uniform solute distribution. One common example of this drying phenomenon which leads to a similar non-uniform deposition of a colored molecule is the 'coffee-drop deposit' where a spilled coffee droplet will result in a ring with a much darker color at the outer edge of the droplet.

Some, but not all, chemicals dissolve in water by hydrogen bonding with water molecules. In general, both the strength of a hydrogen bond and solubility decrease with increasing temperature. Exposing chemicals that dissolve in water through hydrogen bonding to a higher temperature will weaken the bonds between the chemicals and the water, decrease the solubility of the chemical, and in many cases increases the surface activity of the chemical. This increase in surface activity results in greater deposition of the chemical on the load and less chemical transported with the solution. Also, as discussed above, controlling the evaporation of the water will affect the uniformity. Hence, increasing the temperature of the concentrated treating chemistry that is uniformly distributed on the load without a high evaporation rate results in very uniform chemical deposition on the load.

Examples of chemicals that dissolve in water by hydrogen bonding with water molecules include poly(ethylene oxide), poly(vinyl amine) based polymeric colorants, and non-ionic surfactants. For non-ionic surfactants and/or co-polymers with intra-functional groups differing in hydrophobicity, increasing temperature first leads to an increase in surface activity and then can result in crossing the cloud point for that particular chemical. The cloud point of a solution is the temperature at which dissolved solids are no longer completely soluble, precipitating as a second phase giving the fluid a cloudy appearance. The cloud point of some treating chemistries, including not limited to those having surfactants and polymers, may be set by changing the number and type of functional groups. In that sense, treating chemistries may be designed by changing functional groups to have a cloud point close to the first, lower temperature in step 112 to provide for very uniform deposition of the treating chemistry on the laundry. It should be noted that solubility will decrease before reaching the cloud point, and not reaching the cloud point is not necessary to achieve uniform deposition.

Returning to the method, in one example in which the concentrated treating chemistry is a poly(ethylene oxide)

based polymeric colorant, the first temperature and time may be selected to uniformly deposit the polymeric colorant molecules on the load by increasing temperature, which may or may not result in a temperature close to or slightly above the cloud point for the treating chemistry. In this example, the first temperature may be 120° F. or less, or approximately 100-120° F., and heated air at the first temperature may be introduced for approximately four to six minutes. The second temperature may be approximately 140-170° F., and heated air at the second temperature may be introduced until the load is determined to be dry. This determination may be made using input from the moisture sensor 68, and the laundry may be dried until it has a predetermined moisture content.

For a chemistry-enhanced drying cycle, the two-stage heated air introduction may not be necessary. Specifically, the first stage of drying the load at a lower temperature may not be needed. Since the load in a chemistry-enhanced drying cycle will initially be wet, quick evaporation is less likely and uniformity is easier to achieve.

It is notable that the embodiments of the invention may be used with a clothes dryer that does not have a liquid drain system, such as is found in a washing machine or a revitalizing machine. In the latter types of laundry treating appliances, if an excess amount of liquid treating chemistry is dispensed, it is removed from the treating chamber by the liquid drain system. For a clothes dryer without a liquid drain system, excess treating chemistry may pool or puddle in the treating chamber. This may accelerate the normal wear and tear of the structure forming the treating chamber. Furthermore, a current or subsequent load of laundry may absorb some of the excess liquid treating chemistry, resulting in excessively long cycle times and or an undesired treatment, including spotting and over-treatment.

Therefore, for the clothes dryer 10 without a liquid drain system, the amount of liquid treating chemistry dispensed at 100 and 108 may be controlled based not only on the selected cycle of operation, the selected cycle modifiers, and the load amount, but also on the environmental conditions within the treating chamber 34, which may have the effect of evaporating some of the dispensed treating chemistry. Examples of environmental conditions include the air flow conditions and temperature within the treating chamber 34. The dispensing may be controlled such that there is no residual treating chemistry after the completion of a cycle of operation or, if there is residual treating chemistry, the amount of residual treating chemistry will not negatively impact the treatment of the current or subsequent load of laundry.

A clothes dryer using the method 80 will uniformly distribute a liquid treating chemistry onto a load of laundry. By equalizing the surface energy of the load in the pre-wetting phase 98, a liquid treating chemistry can be uniformly distributed onto different fabric types. The method 80 may be useful when using treating chemistries that benefit from a uniform distribution, such as chromophores and stain-repellent chemicals, since uniformity affects the appearance of laundry treated with such treating chemistries, and is therefore critical to the performance of the treating chemistry.

While the invention has been specifically described in connection with certain specific embodiments thereof, it is to be understood that this is by way of illustration and not of limitation, and the scope of the appended claims should be construed as broadly as the prior art will permit. It should also be noted that all elements of all of the claims may be combined with each other in any possible combination, even if the combinations have not been expressly claimed.

What is claimed is:

1. A method of treating laundry in a clothes dryer having a rotating drum defining a treating chamber, the method comprising:

determining a load amount or a fabric type of the laundry;

determining an amount of equalizing liquid, based on the load amount or the fabric type, that will form a layer of the equalizing liquid on the laundry sufficient to equalize a surface energy of the laundry;

forming the layer of the equalizing liquid on the laundry by applying the amount of equalizing liquid to the laundry to equalize the surface energy of the laundry;

applying a treating chemistry on the layer of equalizing liquid after equalizing the surface energy; and drying the laundry within the treating chamber.

2. The method of claim 1, wherein the determining the load amount or the fabric type of the laundry comprises manually selecting the load amount or the fabric type.

3. The method of claim 1, wherein the amount of equalizing liquid comprises an amount which will wet the laundry to a predetermined moisture content.

4. The method of claim 3, wherein the amount of equalizing liquid is based on at least the fabric type, and the predetermined moisture content is one that will saturate the most absorbent fabric in the fabric type.

5. The method of claim 1 wherein applying the amount of equalizing liquid to the laundry comprises spraying the equalizing liquid on the laundry.

6. The method of claim 1 wherein applying the amount of equalizing liquid to the laundry comprises applying the equalizing liquid when a moisture content of the laundry is less than 25%.

7. The method of claim 1 wherein the equalizing liquid is water.

8. The method of claim 1 wherein the treating chemistry comprises a chromophore.

9. The method of claim 1 wherein the treating chemistry comprises a mixture of a chromophore and water.

10. The method of claim 1 wherein drying the laundry comprises drying the laundry to a predetermined moisture content before forming the layer of the equalizing liquid on the laundry.

11. The method of claim 1 wherein drying the laundry further comprises supplying heated air at a first temperature and supplying heated air at a second temperature that is higher than the first temperature.

12. The method of claim 11 wherein the treating chemistry comprises a chromophore, and wherein the supplying heated air at the first temperature uniformly deposits the chromophore on the laundry and the supplying heated air at the second temperature dries the laundry.

13. The method of claim 1, wherein the treating chemistry comprises a stain-repellent chemical.

14. The method of claim 1, further comprising rotating the drum during at least a portion of forming a layer of the equalizing liquid on the laundry or applying the treating chemistry on the laundry.

15. The method of claim 1, wherein applying the treating chemistry comprises applying a predetermined amount of the treating chemistry to the laundry.

16. The method of claim 1, wherein at least a load amount of the laundry is determined, and wherein applying the treating chemistry comprises applying a predetermined amount of the treating chemistry based on the determined load amount.

17. The method of claim 1 wherein applying the treating chemistry comprises spraying the laundry with a liquid treating chemistry.

18. The method of claim 17 wherein spraying the liquid treating chemistry comprises spraying the liquid treating chemistry until a moisture content of the laundry is 10-25%.

19. A method of treating laundry in a clothes dryer having a rotating drum defining a treating chamber, the method comprising:

determining a load amount or a fabric type of the laundry;

determining an amount of liquid, based on the load amount or the fabric type, that will form a liquid transportation layer of the liquid on the laundry sufficient to equalize a surface energy of the laundry;

forming the liquid transportation layer on the laundry by spraying the amount of liquid onto the laundry;

applying a chromophore chemistry on the liquid transportation layer; and drying the laundry after the applying of the chromophore chemistry.

20. The method of claim 19, wherein the determining the load amount or the fabric type of the laundry comprises manually selecting the load amount or the fabric type.

21. The method of claim 19, wherein the amount of liquid is based on at least the fabric type, and the amount of liquid is an amount that will saturate the most absorbent fabric in the fabric type.

22. The method of claim 19, wherein the spraying the amount of liquid onto the laundry comprises saturating the surface of the laundry with sprayed liquid.

23. The method of claim 19 wherein spraying the amount of liquid onto the laundry occurs for a predetermined time.

24. The method of claim 19 wherein spraying the amount of liquid comprises wetting the laundry to a predetermined moisture content.

25. The method of claim 19 wherein spraying the amount of liquid comprises spraying the laundry with the amount of liquid when a moisture content of the laundry is less than 25%.

26. The method of claim 19 wherein the liquid is water.

27. The method of claim 19 wherein the chromophore chemistry comprises a mixture of a chromophore and water.

28. The method of claim 19 wherein applying the chromophore chemistry comprises applying the chromophore chemistry until a moisture content of the laundry is 10-25%.

29. The method of claim 19 wherein drying the laundry comprises drying the laundry to a predetermined moisture content.

30. The method of claim 19 wherein drying the laundry further comprises supplying heated air at a first temperature to uniformly deposit the chromophore chemistry on the laundry and supplying heated air at a second temperature, higher than the first temperature, to dry the laundry.

31. The method of claim 30, wherein supplying heated air at the first temperature bonds molecules of the chromophore chemistry to the laundry.

32. The method of claim 19, further comprising rotating the drum during at least a portion of forming the liquid transportation layer on the laundry or applying the chromophore chemistry on the liquid transportation layer.

33. The method of claim 19 wherein the laundry is dry prior to forming the liquid transportation layer.

34. The method of claim 19 wherein applying the chromophore chemistry comprises spraying the laundry with the chromophore chemistry.

35. A method of treating laundry in a clothes dryer having a rotating drum defining a treating chamber, the method comprising:

applying a treating chemistry containing chromophore molecules on the laundry in the treating chamber to form a treated laundry;

supplying heated air at a first temperature to the treated laundry to uniformly deposit the chromophore molecules on the laundry; and after supplying heated air at the first temperature, supplying heated air at a second temperature, higher than the first temperature, to the treated laundry to dry the laundry;

wherein the first temperature is at or below a cloud point of the treating chemistry.

36. The method of claim 35 wherein applying the treating chemistry comprises equalizing a surface energy of the laundry within the treating chamber.

37. The method of claim 35 wherein applying the treating chemistry comprises applying a predetermined amount of the treating chemistry on the laundry.

38. The method of claim 35 wherein applying the treating chemistry occurs for a predetermined time.

39. The method of claim 35 wherein applying the treating chemistry comprises wetting the laundry to a predetermined moisture content.

40. The method of claim 35 wherein applying the treating chemistry comprises applying the treating chemistry until a moisture content of the laundry is 10-25%.

41. The method of claim 35 wherein the treating chemistry comprises a mixture of chromophore molecules and water.

42. The method of claim 35 wherein supplying heated air at the second temperature comprises drying the laundry to a predetermined moisture content.

43. The method of claim 35, wherein supplying heated air at the first temperature bonds the chromophore molecules to the laundry.

44. The method of claim 35, further comprising rotating the drum during the applying of the treating chemistry.

45. The method of claim 35, further comprising determining a load amount, wherein applying the treating chemistry comprises applying a predetermined amount of the treating chemistry based on the determined load amount.

46. The method of claim 35 wherein the laundry is dry prior to applying the treating chemistry.

47. The method of claim 35 wherein applying the treating chemistry comprises spraying the treating chemistry.

48. The method of claim 35, wherein supplying heated air at the first temperature comprises partially drying the laundry without evaporation of the treating chemistry.

49. The method of claim 35 wherein the first temperature is 100-120° F.

50. The method of claim 49 wherein the second temperature is 140-170° F.

* * * * *